US005980345A

United States Patent [19]

Chang et al.

[11] Patent Number: 5,980,345

[45] Date of Patent: Nov. 9, 1999

[54] SPARK PLUG ELECTRODE HAVING IRIDIUM BASED SPHERE AND METHOD FOR MANUFACTURING SAME

[75] Inventors: Chin-Fong Chang, Morris Plains, N.J.; Richard Dale Taylor; Lee Randall Franz, both of Findlay, Ohio; Edgar Arnold Leone, Randolph, N.J.

[73] Assignee: AlliedSignal Inc., Morristown, N.J.

[21] Appl. No.: 09/114,448

[22] Filed: Jul. 13, 1998

[51] Int. Cl.[6] ..... H01T 21/02

[52] U.S. Cl. ..... 445/7

[58] Field of Search ..... 445/7; 313/141, 313/142, 144

[56] References Cited

U.S. PATENT DOCUMENTS

| | | | |
|---|---|---|---|
| 4,810,220 | 3/1989 | Moore . | |
| 4,826,462 | 5/1989 | Lenk | 445/7 |
| 4,840,594 | 6/1989 | Moore . | |
| 5,273,474 | 12/1993 | Oshima et al. . | |
| 5,395,273 | 3/1995 | Matsutani . | |
| 5,440,198 | 8/1995 | Oshima et al. . | |
| 5,456,624 | 10/1995 | Moore et al. . | |
| 5,461,210 | 10/1995 | Matsutani et al. . | |
| 5,461,275 | 10/1995 | Oshima . | |
| 5,461,276 | 10/1995 | Matsutani et al. . | |
| 5,478,265 | 12/1995 | Matsutani et al. . | |
| 5,488,262 | 1/1996 | Takamura . | |
| 5,497,045 | 3/1996 | Matsutani et al. . | |
| 5,556,315 | 9/1996 | Kagawa . | |
| 5,574,329 | 11/1996 | Kagawa . | |
| 5,578,894 | 11/1996 | Oshima . | |
| 5,578,895 | 11/1996 | Oshima . | |

*Primary Examiner*—Kenneth J. Ramsey

[57] ABSTRACT

A spark plug and method of making same, wherein the spark plug includes an iridium alloy tip portion which may take the form of a rivet or a sphere. The tip portion is coated with platinum, annealed and then resistance welded to a nickel-based electrode of the spark plug. The platinum coating helps to prevent cracks at the welding joint which might otherwise occur due to the differing coefficients of thermal expansion of the iridium-based alloy tip portion and the nickel-based alloy electrode. The iridium alloy tip portion is further not susceptible to attack by lead or combustive gases and therefore increases the life of the spark plug significantly.

9 Claims, 5 Drawing Sheets

SPARK PLUG ELECTRODE HAVING IRIDIUM BASED SPHERE AND METHOD FOR MANUFACTURING SAME

BACKGROUND OF THE INVENTION

1. Technical Field

This invention relates to spark plugs for automotive vehicles, and more particularly to a spark plug having an electrode which includes a tip portion which is highly resistant to wear caused by exposure to lead and oxidation at high temperatures.

2. Discussion

Spark plugs are used in internal combustion engines to ignite fuel in a combustion chamber. The electrodes of a spark plug are subject to intense heat and an extremely corrosive atmosphere generated by the formation of a spark and combustion of the air/fuel mixture. To improve durability and erosion resistance, the spark plug electrode tips must be able to withstand the high temperature and corrosive environment of the internal combustion chamber resulting from the chemical reaction products between air, fuel and fuel additives.

SAEJ312 describes the specification for automotive gasoline used as a fuel in the United States. The gasoline consists of blends of hydrocarbons derived from petroleum: saturates (50–80%), olefins (0–15%), and aromatics (15–40%). Leaded gasoline contains about 0.10 g Pb/gallon fuel (0.026 g Pb/L), and 0.15% sulfur. In unleaded gasoline there is about 0.05 g Pb/gallon, (0.013 g Pb/L), 0.1% sulfur, 0.005 g P/gallon, (0.0013 g P/L). In addition, there are a number of additives incorporated into the fuel for various reasons. For example, tetramethyllead (TML) and tetraethyllead (TEL) are added as antiknock agents. Carboxylic acids (acetic acid), compounds are added as lead extenders. Aromatic amines, phenols are added as antioxidants. Organic bromine, chlorine compounds are added as scavengers and deposit modifiers. Phosphors and boron containing compounds are added to reduce surface ignition, preignition and as engine scavengers. Metal deactivators are added to reduce oxidative deterioration of the fuel by metals, such as Cu, Co, V, Mn, Fe, Cr and Pb. In addition, carboxylic acids, alcohols, amines, sulfonates, phosphoric acid salts of amines, are used as rust-preventing additives.

The mechanism for ignition in an internal combustion engine is very complex and is briefly discussed here. In the gasoline engine, the rising piston compresses the fuel/air mixture, causing increases in pressure and temperature. The spark ignites the fuel-air charge, and the force of the advancing flame front acts against the piston, compressing the unburned fuel-air charge further. Pre-flame combustion reactions occur in the unburned fuel-air mixture. The pinging noise or knock often associated with internal combustion engines is produced when an extremely rapid combustion reaction occurs in the end gas ahead of the advancing flame front. The formation of the preflame reaction products of the gasoline sets the stage for knock. It is believed that the alkyllead additive must first decompose in the combustion chamber to form lead oxide before it can exert its antiknock effect. The antiknock species must be finely dispersed in the combustion chamber so that adequate numbers of collisions of the critical reacting species with the antiknock agent will occur. However, lead oxide deposits can cause problems of valve burning and spark plug fouling. Lead deposits which accumulate on the spark plug insulator cause engine misfiring at high speed due to the relatively high electrical conductivity of the deposit.

The complete combustion of a hydrocarbon fuel with air will produce carbon dioxide ($CO_2$), water ($H_2O$) and nitrogen ($N_2$). The ratio of air to fuel by weight, 14.5/1, is the chemically correct mixture ratio. When less air is available, some carbon monoxide (CO) and hydrogen ($H_2$) are found in the products, whereas if excessive air is available some oxygen ($O_2$) is found in the products. The atmosphere present during the combustion may cause the hot corrosion of electrodes in the spark plug.

The manufacture of copper (Cu) and nickel (Ni) electrodes for spark plugs is a proven art and has been accomplished in a variety of ways. For instance, U.S. Pat. No. 3,803,892 issued Apr. 16, 1974 and entitled "Method of Producing Spark Plug Center Electrode" describes a method of extruding copper and nickel electrodes from a flat plate of the two materials. U.S. Patent No. 3,548,472 issued Dec. 22, 1970 and entitled "Ignition Plug and Method for Manufacturing a Center Electrode for the Same" illustrates a method of cold forming an outer nickel cup shaped sleeve by several steps, inserting a piece of copper wire into the cup and then lightly pressing the two materials together. U.S. Pat. No. 3,857,145 issued Dec. 31, 1974 and entitled "Method of Producing Spark Plug Center Electrode" discloses a process whereby a copper center core is inserted into a nickel member and attached thereto by a collar portion to assure that an electrical flow path is produced.

The spark plug electrodes produced by the methods disclosed above perform in a satisfactory manner for a relatively short period of driving time when used in vehicles that were manufactured prior to the implementation of the clean air act of 1977 in the United States. After 1977, with modifications to engine and fuel, the operating temperature of most vehicle increased. As a result of the changes in the engines and fuels, some of the operating components in engines have been subjected to the corrosive effects of the exhaust gases. After a period of time of operating at higher temperatures in recirculation gases, some corrosion/erosion can occur at the nickel-based center electrode. Once corrosion has taken place, the electrical flow path deteriorates which can result in lower fuel efficiency.

Presently manufactured spark plugs for automotive vehicles typically include an electrode which is manufactured from nickel. The electrode also typically includes a very small tip portion which is welded to the electrode during manufacture of the spark plug. The tip portion can be in the shape of a sphere or a rivet and is comprised typically of platinum (about 90%) and nickel (about 10%).

The problem with such spark plugs having platinum-nickel tip portions is that the platinum is susceptible to attack by lead and the nickel is susceptible to selective oxidation at high temperatures. This limits the life of the spark plug.

There is thus a need for a spark plug having an electrode construction which allows for a long life (for example, 150,000 miles) of operation before the spark plug requires replacing. There is further a need for such a long life spark plug which can be manufactured by present day manufacturing procedures, which is not appreciably more expensive than presently manufactured spark plugs, and which includes an electrode which is highly resistant to attack by lead and selective oxidation at high operating temperatures.

SUMMARY OF THE INVENTION

The present invention relates to a long-life spark plug and a method of manufacturing same. The spark plug comprises at least one electrode, and preferably a pair of electrodes, each of which include a tip portion welded thereto. The tip portion is comprised of iridium or a combination of iridium and rhodium.

During manufacture, the tip portion is first cleaned and then coated with a layer of platinum. The layer of platinum has a thickness of preferably in the range of between about 5–15 microns, and more preferably about 10 microns. In one preferred embodiment the tip portion comprises a sphere. In an alternative preferred embodiment the tip portion comprises a very small rivet.

Once the tip portion is coated it is annealed. The annealing is performed at a temperature between about 700° C. and 1400° C., and more preferably at about 950° C., for about 5–30 minutes, and more preferably between about 5–15 minutes. The annealed tip portion is then placed in a fixture and the electrode of the spark plug is aligned with the tip portion such that the tip portion is in contact with an edge of the electrode. The tip portion is then welded to the electrode. The same procedure is preferably performed on both of the electrodes of the spark plug.

The iridium or iridium-rhodium tip portions have high resistance to attack by lead. The platinum coating applied to each tip portion further helps to ensure against welding cracks that might occur due to differing coefficients of thermal expansion between the nickel-based electrode and the iridium or iridium-rhodium tip portions.

The resulting spark plug has an extremely long life (approximately 150,000 miles or more). The gap established between the two electrodes of the spark plug is further maintained for the life of the spark plugs since the tip portions attached to each of the electrodes of the spark plug are substantially unaffected by leaded or unleaded fuels or by the combustion gases produced in the combustion chambers of an internal combustion engine.

BRIEF DESCRIPTION OF THE DRAWINGS

The various advantages of the present invention will become apparent to one skilled in the art by reading the following specification and subjoined claims and by referencing the following drawings in which:

DETAILED DESCRIPTION OF THE PREFERRED EMBODIMENTS

Figure 1:
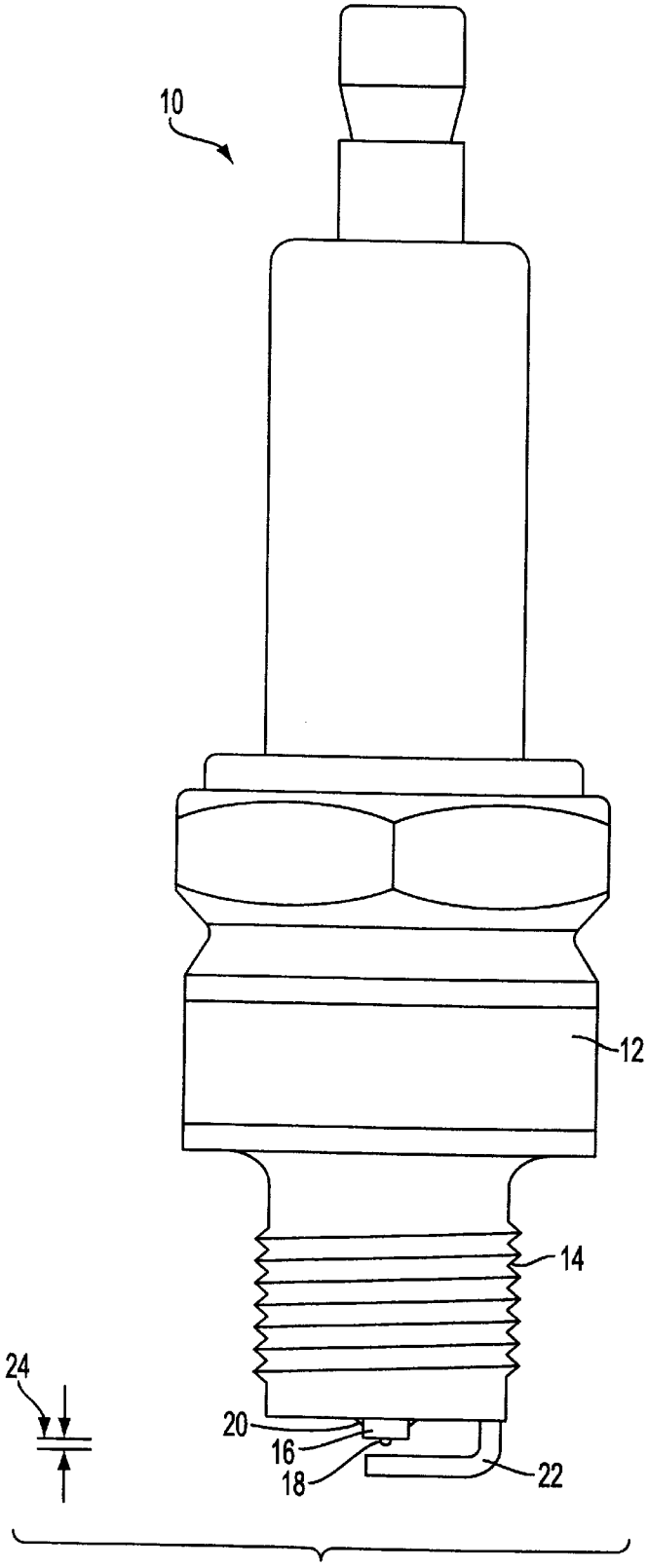
FIG. 1 is an elevational view of a spark plug in accordance with a preferred embodiment of the present invention incorporating an iridium alloy tip portion.

Referring to FIG. 1, a spark plug 10 is shown in accordance with a preferred embodiment of the present invention. Spark plug 10 includes an annular metal housing 12 having threads 14 formed thereon, a center electrode 16 having a tip portion 18, an insulator 20 for supporting the center electrode 16 and a side or ground electrode 22 electrically coupled to and supported by the metal housing 12. As is well known, it is desirable to maintain the distance between the tip portion 18 and the side electrode 22, hereinafter referred to as the spark plug "gap" 24, constant over the life of the spark plug 10.

The tip portion 18 has heretofore been manufactured from platinum, which has been found to provide reasonably good resistance to spark erosion in the presence of combustive gases present in the combustion chamber of an internal combustion engine. Nevertheless, the platinum tip portion 18, which is shown in FIG. 1 in the shape of a rivet, is still susceptible to attack by lead, which is present in some fuels still being used with internal combustion engines. As a result, the erosion and deterioration of the tip portion 18 causes the gap 24 to widen, thus weakening the spark that the spark plug 10 produces.

It has been found that iridium has excellent resistance to attack by a wide range of molten metals. Iridium has been found by the co-inventors of the present invention to be superior to platinum in withstanding attack by lead. However, the coefficient of thermal expansion (CTE) of iridium differs significantly from nickel, which is the material the electrode 16 is typically constructed of. This difference in the coefficient of thermal expansion can cause cracking to occur at the area where the tip portion and the electrode are joined as the tip portion and electrode heat up during use of the spark plug 10. Thus, an iridium tip portion cannot simply be resistance welded or otherwise secured to an electrode comprised of nickel without eventually experiencing cracks or breaks at the joint between these components.

Figure 2:
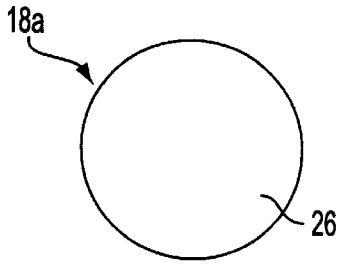
FIG. 2 is an elevational view of an iridium alloy sphere-shaped tip portion.
Figure 3:
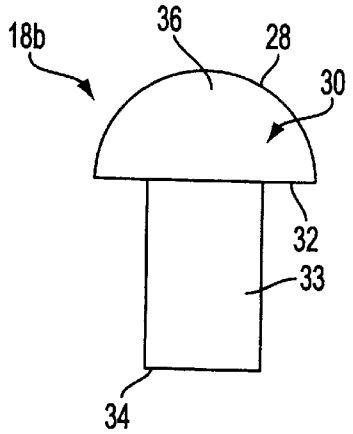
FIG. 3 is an elevational side view of an iridium alloy rivet-shaped tip portion in accordance with a preferred embodiment of the present invention.

Referring now to FIGS. 2 and 3, there are shown two embodiments of the tip portion 18 of the present invention. In FIG. 2, the tip portion 18*a* comprises a sphere having a platinum coating 26 thereon. The coating is preferably between 5–15 microns in thickness, and more preferably about 10 microns in thickness. The diameter of the sphere may vary significantly, but is preferably within the range of about 0.38–1.14 mm, and more preferably about 0.76 mm. The weight of the sphere is preferably within the range of about 50–60 mg, and more preferably about 54–55 mg.

Figure 4:
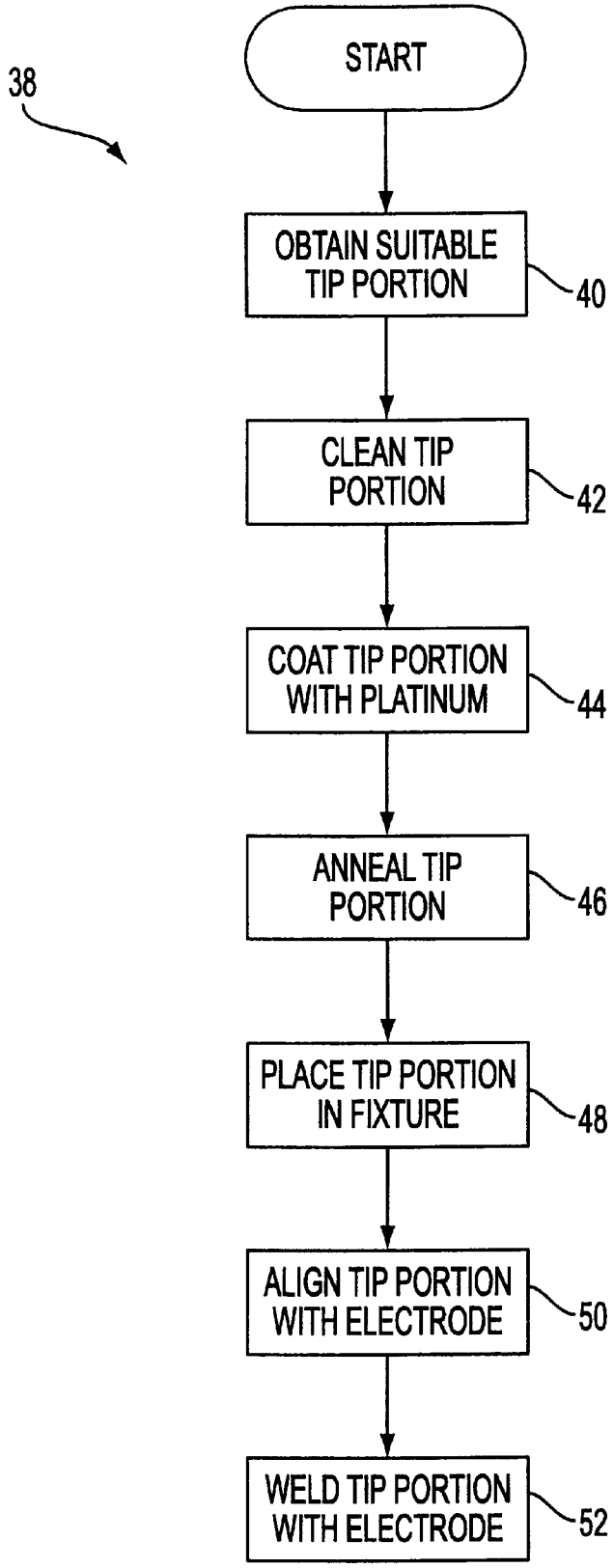
FIG. 4 is a flowchart of the steps used to coat and weld a tip portion to an electrode of a spark plug.

FIG. 3 illustrates the tip portion 18*b* in the form of a rivet. The tip portion 18*b* includes a head 28 having a continuous, semi-spherical outer surface 30 and a flat portion 32. A shank 33 extends from the flat portion 32 and has a flat outer surface 34. At least the head portion 28 includes a platinum coating 36 thereon although, with the present manufacturing methods, it is significantly easier to simply coat the entire tip portion 18*b* with platinum. The thickness of the platinum coating is also preferably between about 5–15 microns, and more preferably about 10 microns. Referring now to FIG. 4, a flowchart 38 illustrates the steps performed in coating and welding the tip portion 18 to the electrode 16. Initially, an iridium or iridium-rhodium tip portion is obtained, as indicated at step 40. Such tip portions are commercially available from the Joint-Stock Company, Ekateringburg Non-Ferrous Metal-Processing Plant, 8 Lenin Avenue, Ekateringburg, Russia. The tip portions have a total surface area preferably about 10 $cm^2$. At step 42, the tip portion 18 is cleaned with acetone or any other suitable cleaner and then rinsed with deionized or distilled water or another suitable rinsing agent. The tip portion 18 is then coated with platinum, as indicated at step 44. This is accomplished by first making up an electroless, platinum plating bath comprised of:

platinum diamine dinitrite (60% Pt)–1.67 g/L hydrazine hydrate—0.13 g/L ammonium hydroxide (25%)—100 mL/L The tip portions are then placed in a glass beaker, the platinum plating bath is added to the glass beaker and the beaker is covered with watch glass and kept at preferably about 80–85° C. for about 3–10 hours. The tip portions 18 are then removed from the glass beaker, rinsed with water, dried and the weight of each checked along with the platinum thickness on each tip portion. The thickness can be calculated by the following formula:

$$h=0.47\ m/s$$

where:

h=Pt thickness (in microns)

m=Pt weight (in milligrams)

s=Pt coated surface area (100 $cm^2$)

The platinum thickness coating on the tip portion preferably is at least about 10 microns. If the thickness is not at least 10 microns, the above plating procedure is performed a second time.

Figure 7:
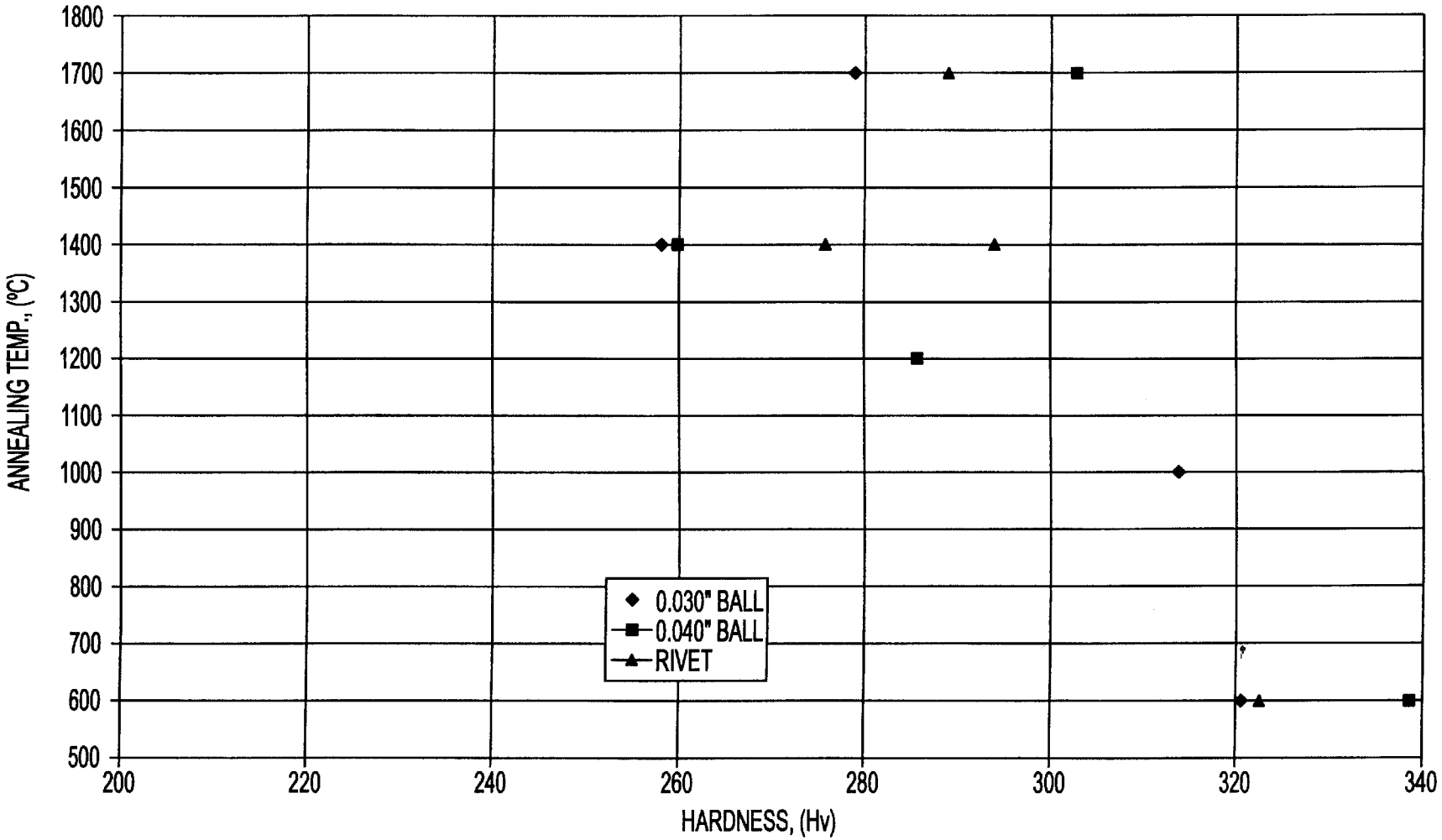
FIG. 7 is a graph illustrating the hardness achieved for the tip portion at various annealing temperatures.

Referring further to FIG. 4, the tip portion 18 is then annealed, as indicated at step 46. This involves placing the platinum coated spheres or rivets in a suitable holder such as a holder made from quartz, ceramic, porcelain or stainless steel, and placing the holder in the annealing furnace while the furnace is maintained at a temperature of between about 700–400° C., and more preferably at about 950° C., for preferably about 5–30 minutes, and more preferably about 5–15 minutes. Preferably, the interior of the annealing furnace is subjected to a vacuum or contains nitrogen, argon or hydrogen. The annealing process will allow the inter-diffusion of platinum and iridium or rhodium and helps to significantly improve the bonding strength between the iridium alloy tip and platinum. A complete solid solution of platinum and iridium or rhodium will allow the slow transition of the thermal expansion coefficient from platinum to iridium alloy. The desired annealing condition can be achieved by checking the various hardnesses as a function of annealing temperatures shown in FIG. 7.

With further reference to FIG. 4, the tip portion 18 is then placed in a welding fixture, as indicated at step 48. The electrode 16 is then aligned with the tip portion, as indicated at step 50, and the tip portion 18 is resistance welded to the electrode 16, as indicated at step 52.

Figure 5:
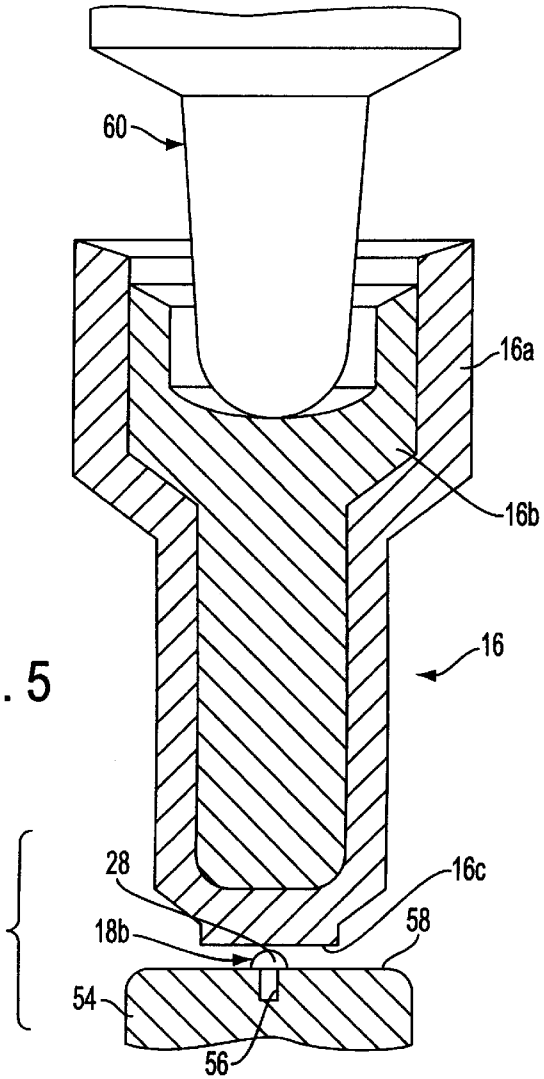
FIG. 5 is a simplified drawing of a welding tool used to resistance weld the tip portion to a center electrode, where the tip portion comprises a rivet-shaped tip portion.

With brief reference to FIG. 5, the welding fixture comprises a portion of a welding electrode 54 having a recess 56 formed in an upper surface 58 thereof for holding and maintaining a rivet-shaped or sphere-shaped tip portion 18 stationary during the welding process. The electrode 16 can be seen to include an outer portion 16*a* made of nickel and a copper core 16*b*. A welding electrode tip 60 is used to apply pressure to the core 16*b* of the electrode 16 during the welding process. During this process nickel flows around the head 28 of the rivet 18*b* when the lower surface 16*c* of the electrode 16 is lowered into contact with the tip portion 18*b* during the welding process. In this manner the rivet 18*b* becomes securely fixed to the electrode 16. Better bonding strength between the platinum coated iridium alloy tip and the nickel alloy electrode can be achieved by the resistance welding process as described in this application due to the inter-diffusion of platinum and nickel. Intermediate phases such as (Ni, Pt), $Ni_3$ Pt and NiPt can be formed between platinum and the nickel alloy electrode which will minimize the mismatch in the thermal expansion coefficient between platinum and nickel alloy. It is a principal advantage of the present invention that the platinum coating of the tip portion 18*b* serves to better match the coefficient of thermal expansion of the electrode 16 to the tip portion 18 to ensure against cracks and stress fractures as the electrode goes from room temperature to an operating temperature during use.

Figure 6:
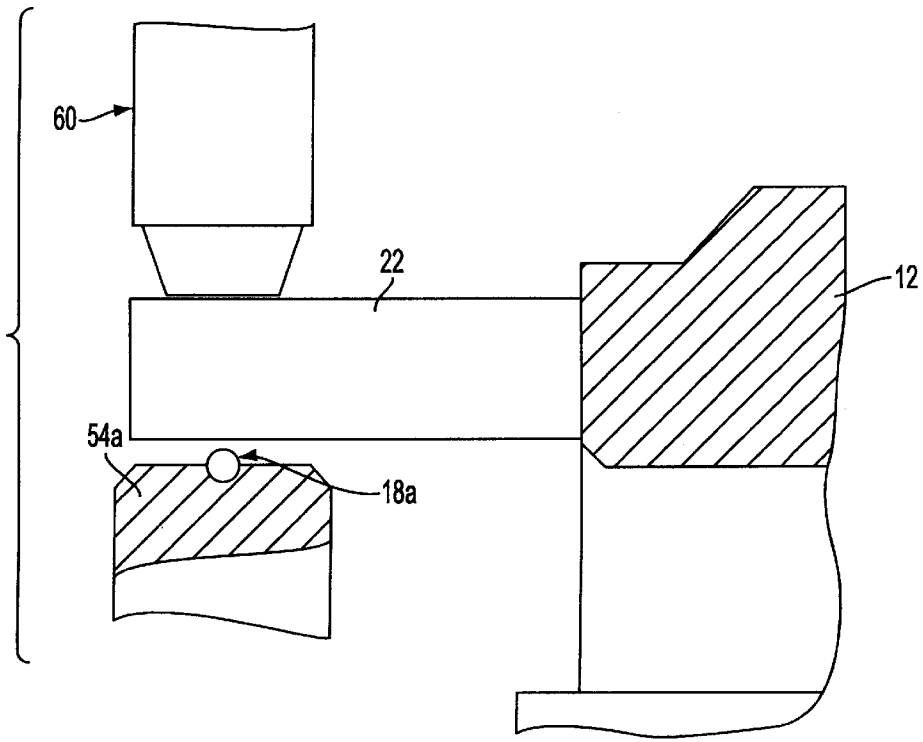
FIG. 6 is a simplified view of a welding tool used to resistance weld the tip portion to a side electrode of a spark plug, where the tip portion comprises a sphereshaped tip portion.

With brief reference to FIG. 6, a welding electrode portion 54*a* suitable for holding the sphere-shaped tip portion 18*a* is illustrated. In this figure the tip portion 18*a* is shown being welded to the side electrode 22 of the spark plug 10.

Figure 8:
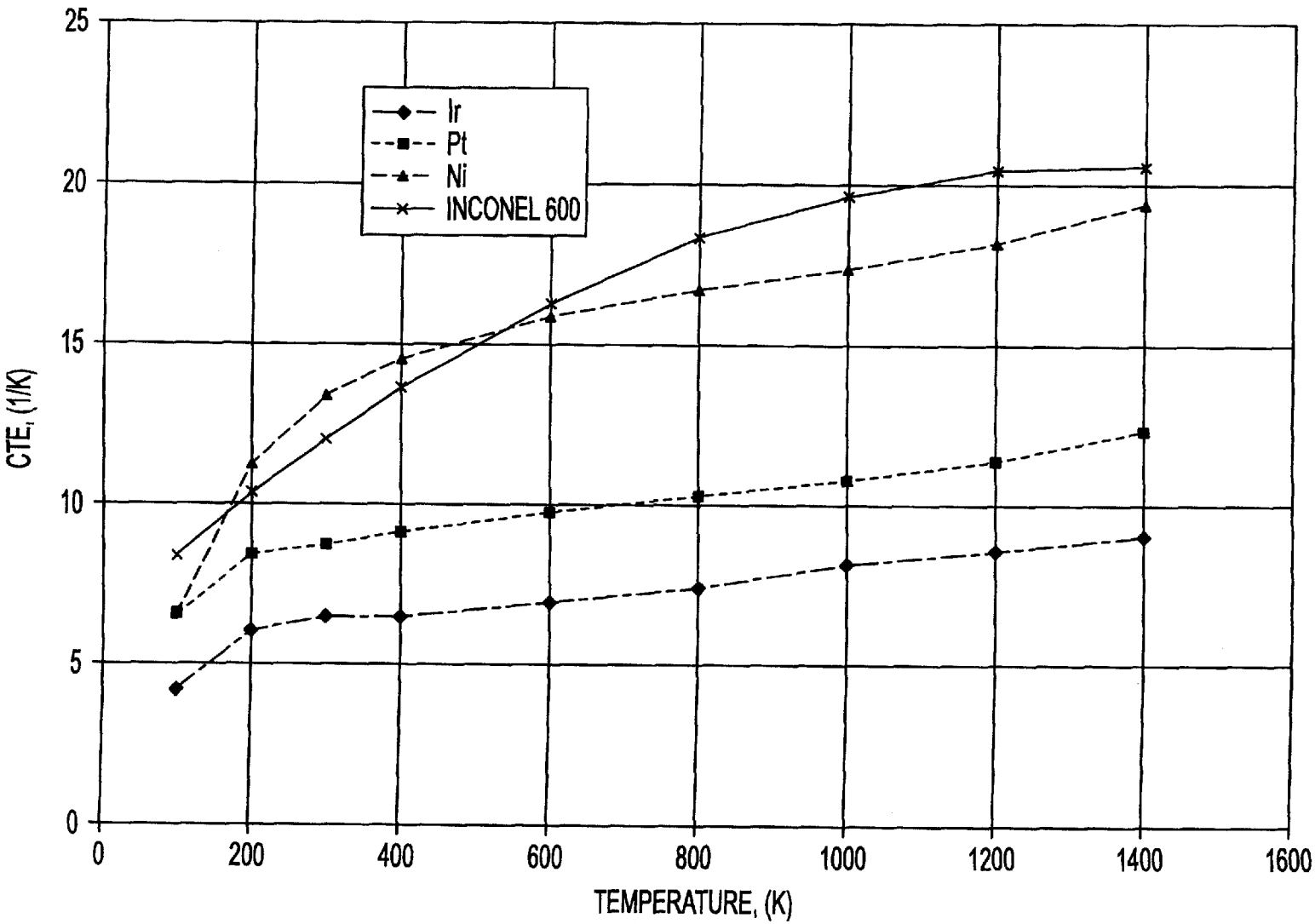
FIG. 8 is a graph illustrating the coefficient of thermal expansion for the various materials used in the construction of the spark plug.

While nickel has been described as one preferred material for the electrode 16, even more preferable materials are commercially available Inconel 600 or Hoskins 831 or 592. FIG. 8 illustrates that the coefficient of thermal expansion of platinum more closely tracks that of nickel or Inconel 600 at various temperatures.

The spark plug construction of the present invention provides for an extremely long life spark plug. The iridium tip portion 18 described herein is highly resistant to lead and other combustive gases, which enables the gap between the center and side electrodes to be maintained constant over a longer period of use, thereby insuring that a strong spark will be generated between the electrodes 18 and 22. The platinum coating ensures that stress cracks do not develop at the welded areas of the tip portion and the electrode.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

What is claimed is:

1. A method for constructing an electrode for a spark plug using a pre-formed tip portion comprised at least in part of iridium alloy, said method comprising the steps of:

coating the tip portion with platinum;

placing the tip portion in a fixture;

aligning the tip portion with the electrode; and welding the tip portion to the electrode.

2. The method of claim 1, further comprising the step of annealing the tip portion at a temperature within a range of approximately 700°–1400° C. prior to welding the tip portion to the electrode.

3. The method of claim 2, wherein the step of annealing the tip portion comprises annealing the tip portion for a time between about 5–30 minutes.

4. The method of claim 3, wherein the step of annealing the tip portion comprises annealing the tip portion for a time between about 5–15 minutes.

5. The method of claim 1, wherein the step of coating the tip portion comprises the steps of:

cleaning the tip portion with a cleaning solvent;

rinsing the tip portion with a rinsing solution;

placing the tip portion in an electroless platinum plating bath for a predetermined time period and at a predetermined temperature to form a platinum coating thereon; and rinsing the tip portion.

6. The method of claim 5, wherein the predetermined time period comprises a range of about 3–10 hours.

7. The method of claim 5, wherein the predetermined temperature comprises a temperature within the range of about 80–85 degrees C.

8. The method of claim 5, further comprising the step of checking the thickness of the tip portion to ensure the tip portion has a platinum coating of at least about 10 microns.

9. The method of claim 5, wherein the platinum plating bath comprises a solution of platinum diammine dinitrite, hydrazine hydrate and ammonium hydroxide.

* * * * *